US007051815B2

(12) United States Patent
Ireland et al.

(10) Patent No.: US 7,051,815 B2
(45) Date of Patent: May 30, 2006

(54) WELL PUMP CAPSULE

(75) Inventors: Floyd D. Ireland, Quito (EC); Janislene S. Ferreira, Rio de Janeiro (BR)

(73) Assignee: Baker Hughes Incorporated, Houston, TX (US)

( * ) Notice: Subject to any disclaimer, the term of this patent is extended or adjusted under 35 U.S.C. 154(b) by 119 days.

(21) Appl. No.: 10/639,557

(22) Filed: Aug. 12, 2003

(65) Prior Publication Data

US 2004/0035585 A1 Feb. 26, 2004

Related U.S. Application Data

(60) Provisional application No. 60/405,272, filed on Aug. 22, 2002.

(51) Int. Cl.
*E21B 43/38* (2006.01)

(52) U.S. Cl. ..... 166/369; 166/105.1

(58) Field of Classification Search ..... 166/105, 166/105.1, 107, 369
See application file for complete search history.

(56) References Cited

U.S. PATENT DOCUMENTS

| | | | | |
|---|---|---|---|---|
| 4,537,257 | A | 8/1985 | Todd | |
| 5,554,897 | A | 9/1996 | Martin et al. | |
| 6,056,511 | A | 5/2000 | Kennedy et al. | |
| 6,126,416 | A | 10/2000 | Lee | |
| 6,179,056 | B1 * | 1/2001 | Smith | 166/313 |
| 6,216,788 | B1 | 4/2001 | Wilson | |
| 6,328,111 | B1 | 12/2001 | Bearden et al. | |
| 6,364,013 | B1 | 4/2002 | Watson et al. | |
| 6,457,522 | B1 | 10/2002 | Bangash et al. | |
| 6,457,531 | B1 | 10/2002 | Bangash et al. | |
| 6,508,308 | B1 | 1/2003 | Shaw | |
| 6,533,033 | B1 | 3/2003 | Skillman | |
| 6,568,475 | B1 | 5/2003 | Grubb et al. | |
| 6,595,295 | B1 | 7/2003 | Berry et al. | |
| 2003/0141056 | A1 * | 7/2003 | Vandevier | 166/265 |

OTHER PUBLICATIONS

Technical Paper Data Base Entry Worksheet, *Series Boosting Techniques Achieve 1,200 to 2,000 Horsepower Electric Submersible Pump Deployment,* by author: Carlos Moreno, co-authors: David Randolf Smith and Floyd Ireland, published Apr. 29, 1998, 19 pages.

* cited by examiner

*Primary Examiner*—William Neuder
(74) *Attorney, Agent, or Firm*—Bracewell & Giuliani LLP

(57) ABSTRACT

In the well assembly of the invention, a downhole pump assembly has an intake and a discharge outlet. A capsule enclosing the pump assembly selectively isolates the pump assembly from well fluid by way of a flow control device. A conduit having open upper and lower ends extends sealingly through the capsule for accessing a portion of the well below the capsule. The invention also includes a method of pumping fluid from a well wherein a pump assembly enclosed in a capsule is protected from pressure. In this method, the pump is shut off and well fluid is blocked from the interior of the capsule. Pressure is then applied to the well fluid surrounding the capsule, the capsule isolating the pump assembly from the pressure.

24 Claims, 1 Drawing Sheet

WELL PUMP CAPSULE

RELATED APPLICATIONS

Applicants claim priority to the invention described herein through a United States provisional patent application titled "Well Pump Capsule," having U.S. patent application Ser. No. 60/405,272, which was filed on Aug. 22, 2002, and which is incorporated herein by reference in its entirety.

BACKGROUND OF THE INVENTION

1. Field of the Invention

This invention relates in general to well pumps, and in particular to a well pump enclosed by a capsule that selectively isolates the pump from annulus pressure within the well while permitting access to a portion of the well below the capsule.

2. Background of the Invention

Well pumps are utilized in low-pressure hydrocarbon wells for pumping the fluid to the surface. Submersible well pumps are mounted to an electrical motor, the pump and motor being submerged in the well. Typically, the pump has the discharge end connected to a string of tubing that extends to the surface of the well. Electrical power is supplied from the surface for operating the motor to drive the pump.

For certain remedial interventions, such as chemical/acid squeeze operations, the pump unit will be pulled along with the string of tubing. Test samplers and valves may be set below the pump unit to apply a high-test pressure to the well before the unit is pulled. This high pressure in the well annulus can damage the pump unit.

Previously, pump assemblies have been placed within shrouds or capsules for protection from sand or corrosion. These prior designs do not, however, disclose a selectively sealable capsule that permits access to a well below the level of the capsule. The prior art also does not disclose a method of protecting a submersible pump assembly from high pressure by enclosing it in a selectively sealable capsule.

SUMMARY OF THE INVENTION

In the well assembly of this invention, a downhole pump assembly has an intake and a discharge outlet. A capsule enclosing the pump assembly selectively isolates the pump assembly from well fluid by way of a flow control device. A conduit having open upper and lower ends extends sealingly through the capsule for accessing a portion of the well below the capsule. The well assembly may also include a string of tubing for supporting the pump assembly and through which the well fluid may flow after discharge by the pump.

This invention also includes a method of pumping fluid from a well wherein a pump assembly enclosed in a capsule is protected from pressure. In this method, the pump is shut off and well fluid is blocked from the interior of the capsule. Pressure is then applied to the well fluid surrounding the capsule, the capsule isolating the pump assembly from the pressure. The method may also be performed by applying pressure to the well fluid by pumping from the surface down a string of tubing or by lowering a tool down a string of tubing into the well below the capsule by way of a conduit running through the capsule.

BRIEF DESCRIPTION OF THE DRAWINGS

The novel features believed to be characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings.

DETAILED DESCRIPTION OF THE PREFERRED EMBODIMENT

Figure 1A:
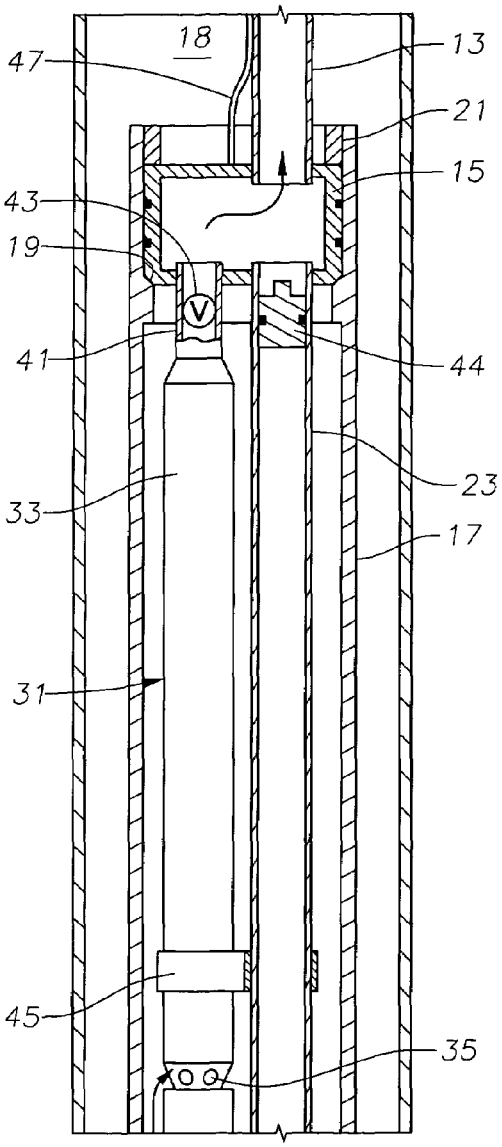
FIGS. 1A and 1B comprise a sectional, schematic view of a pump assembly constructed in accordance with this invention.
Figure 1B:
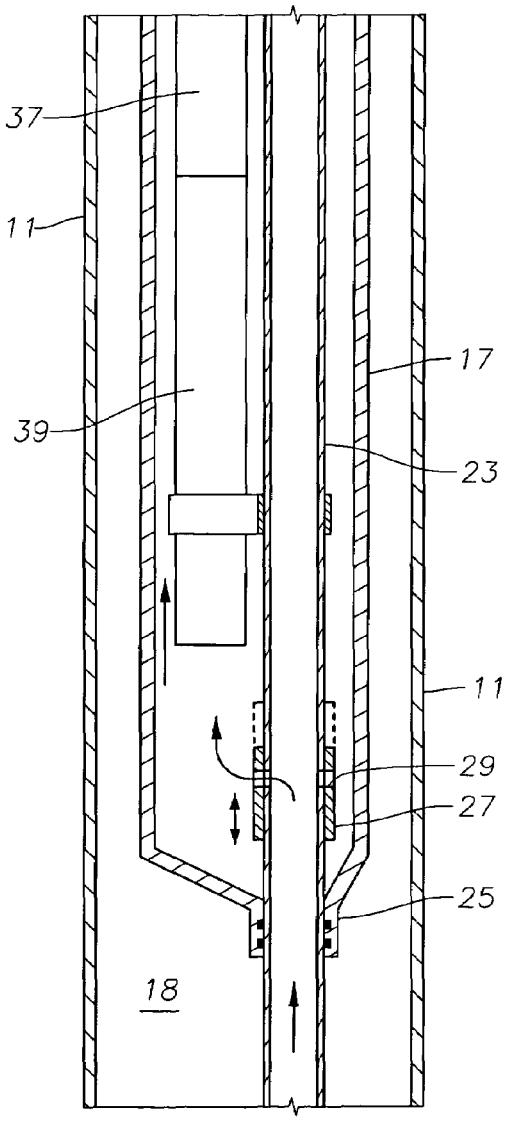

The well shown in the drawings has a casing 11 that is cemented in place. A string of tubing 13 extends downward in casing 11 for delivering produced well fluids to the surface. Tubing 13 is secured by threads to the upper end of a manifold 15.

Manifold 15 is located at the upper end of a capsule 17, which may also be considered as sealed housing or shroud. The upper and lower ends of capsule 17 are sealed from the well fluid in the annulus 18 that surrounds tubing 13 and capsule 17. In this embodiment, manifold 15 is supported on a shoulder 19 within capsule 17, has seals that seal it to the internal sidewall of capsule 17, and is held in place by a threaded lock ring 21 on its upper end. Manifold 15 is a hollow tubular member having an upper end that secures to tubing 13. The common longitudinal axis of manifold 15 and capsule 17 is offset from the longitudinal axis of tubing 13.

A conduit 23 secures by threads to a lower end of and extends downward from manifold 15 within capsule 17. Conduit 23 may be the same diameter and wall thickness as tubing 13. The lower end of conduit 23 extends sealingly out through a lower aperture 25 in the closed lower end of capsule 17. Conduit 23 is coaxial with tubing 13, but the upper end of conduit 23 is spaced below the lower end of tubing 13 a short distance in this embodiment. Both conduit 23 and tubing 13 thus communicate with the hollow interior or chamber within manifold 15.

Conduit 23 has a port 29 located above aperture 25 that communicates the interior of conduit 23 with the interior of capsule 17. A valve 27 will selectively open and close port 29 without affecting any upward or downward flow through conduit 23. Preferably valve 27 is a sliding sleeve that surrounds conduit 23 and has a piston portion that causes valve 27 to move axially in response to hydraulic pressure. The hydraulic pressure is supplied remotely from the surface through a hydraulic line (not shown) that extends alongside tubing 13 and into capsule 17. Valve 27 may be biased normally open by a spring (not shown).

A pump assembly 31 is mounted entirely within capsule 17. Pump assembly 31 is preferably an electrical submersible pump assembly having a centrifugal pump 33. However, it could be other types, such as a progressing cavity pump. Pump 33 is a long tubular member that has a plurality of stages of impellers and diffusers. Intake 35 is preferably located at the lower end, which is within the interior of capsule 17. Pump 33 is connected to a conventional seal section 37 and a motor 39. Motor 39 is an a/c electrical motor filled with a dielectric lubricating oil. Seal section 37 reduces pressure differential between the hydrostatic pressure surrounding motor 39 and the pressure of the lubricant within motor 39.

The upper end of pump 33 is connected to a discharge tube 41, which in turn connects by threads to the lower end of manifold 15. A check valve 43 is located in discharge tube 41. Check valve 43 allows fluid to discharge from pump 33 into manifold 15 but prevents reverse flow. Pump assembly 31 is parallel to conduit 23 and strapped alongside by straps 45.

Preferably, conduit 23 has a closure mechanism above port valve 27 to prevent the discharge from pump 33 from flowing back downward in conduit 23. One type of closure mechanism comprises a plug profile in conduit 23 that releasably receives a wireline plug 44 run on a wireline. A remotely actuable ball valve would also work in lieu of wireline plug 44. Electrical and hydraulic lines 47 extend from the surface alongside tubing 13 and through manifold 15. Lines 47 extend to motor 39 for delivering electrical power and to port valve 27 for hydraulic fluid pressure.

In operation, pump assembly 31 is mounted in capsule 17, and the entire assembly is lowered into casing 11 on tubing 13. Wireline plug 44 is lowered on wireline into place in conduit 23. Port valve 27 is opened by supplying hydraulic power to it. Electrical power is supplied to pump assembly 31, causing well fluid to be drawn through the lower end of conduit 23. As indicated by the arrows, the well fluid flows out port 29, alongside motor 39, seal section 37 and into intake 35. Pump 33 discharges the well fluid into manifold 15. Wireline plug 44 within conduit 23 prevents flow back downward in conduit 23, forcing the well fluid to flow upward through tubing 13 to the surface.

If the operator wishes to run wireline tools or coiled tubing through tubing 13 to below capsule 17, pump assembly 31 would normally be turned off. The operator would then engage wireline plug 44 with a wireline tool and retrieve it. If it is desired to pressurize tubing annulus 18, the operator will close port valve 27, then apply the pressure to tubing annulus 18. Pressure can be applied by pumping down tubing 13 and conduit 23. Alternately, pressure can be applied by a test sampler and valve set below capsule 17. Port valve 27 and check valve 43 isolate pump assembly 31 from pressure in annulus 18. It is not necessary for wireline plug 44 to be in place while tubing annulus 18 is pressurized because of the protection provided by check valve 43 and port valve 27.

Variations to the invention as shown may be made. For example, although manifold 15 is shown to be a tubular member having a central chamber, it could be of another configuration. For example, it could comprise a Y-tube, having an upper branch that connects to tubing 13 and two lower branches, one of which connects to discharge tube 41 and the other to conduit 23. If the operator does not plan to pump down tubing 13 on any occasion, check valve 43 could be eliminated as long as wireline plug 44 is in place when tubing annulus 18 is pressurized. If the operator has no intention of running wireline tools or coiled tubing down tubing 13 and conduit 23 below capsule 17, then conduit 23 could be eliminated. In that event, pump assembly 31 could be connected directly to tubing 13 without valve 43. The opening in the lower end of capsule 27 would require a valve operable from the surface for selectively opening and closing the interior of capsule 27 to the well fluid.

We claim:

1. A well assembly comprising:

a string of tubing for installation in a well;

a downhole pump assembly, the pump assembly having an intake and a discharge outlet;

a capsule suspended on the string of tubing, the capsule having a sealed interior with an inlet in fluid communication with an annulus surrounding the string of tubing and the capsule and an outlet connected to the tubing;

a downhole pump assembly located within the sealed interior of the capsule, the pump assembly having an intake in fluid communication with the inlet of the capsule and a discharge outlet in fluid communication with the outlet of the capsule; and a flow control device at the inlet of the capsule having an open position for selectively communicating the well fluid in the annulus to the sealed interior of the capsule and to the intake of the pump assembly, the flow control device having a closed position isolating the well fluid in the annulus from the intake of the pump assembly, enabling pressure to be applied to the well fluid in the annulus without increasing pressure on the pump assembly within the sealed interior of the capsule.

2. The well assembly according to claim 1, further comprising a conduit extending alongside the pump assembly within the sealed interior of the capsule, the conduit having an upper end in fluid communication with the outlet of the capsule and a lower end in fluid communication with the inlet of the capsule.

3. The well assembly according to claim 2, wherein the pump assembly is offset from an axis of the tubing.

4. The well assembly according to claim 2, wherein the upper end of the conduit is coaxially aligned with the string of tubing.

5. The well assembly according to claim 2 further comprising: a partition in the sealed interior of the capsule, defining a discharge chamber and an intake chamber in the sealed interior that are sealed from each other by the partition, the discharge chamber being in fluid communication with the string of tubing; and wherein the upper end of the conduit and the discharge of the pump assembly are in fluid communication with the discharge chamber.

6. The well assembly according to claim 5 further comprising a retrievable plug installed within the conduit for selectively preventing the well fluid being discharged by the pump from flowing down the conduit.

7. The well assembly according to claim 6, further comprising a discharge valve at the discharge outlet of the pump assembly for blocking well fluid in the discharge chamber from flowing back into the discharge outlet of the pump assembly when the pump assembly is not operating.

8. The well assembly according to claim 5, wherein the the intake of the pump assembly is located in the intake chamber of the capsule.

9. The well assembly according to claim 2 wherein the flow control device is located within the conduit inside the capsule.

10. The well assembly according to claim 1, wherein the flow control device comprises a valve.

11. The well assembly according to claim 1, wherein a lower end of the pump assembly is located within the sealed interior above a lower end of the capsule.

12. A well assembly comprising:

a string of tubing for installation in a well;

a capsule supported by the string of tubing;

a pump assembly inside the capsule, the pump assembly having an intake and a discharge outlet that communicates with the tubing;

an opening in the capsule that admits a well fluid into an interior of the capsule;

a valve at the opening to selectively block the well fluid from the interior of the capsule; and a conduit within the capsule running parallel to the pump assembly, the conduit having an open lower end extending sealingly through the lower end of the capsule for accessing a portion of the well below the capsule.

13. The well assembly according to claim 12, wherein the conduit is in axial alignment with the tubing, the intake is on a lower end of the pump assembly, and the discharge outlet is on an upper end of the pump assembly.

14. The well assembly according to claim 12, further comprising a manifold that communicates an upper end of the conduit and the discharge outlet of the pump assembly with the tubing.

15. A well assembly comprising:

a downhole pump assembly supported by a string of tubing in a well, the pump assembly having a lower intake and an upper discharge outlet that communicates with the tubing;

a capsule enclosing the pump assembly for isolating the pump assembly from well fluid, the capsule having an upper end suspended on the tubing and a lower aperture;

a conduit within the capsule running parallel to the pump assembly, the conduit having an upper end that is in axial alignment with the tubing, and an open lower end extending sealingly through the lower aperture of the capsule for receiving the well fluid;

a manifold that communicates the upper end of the conduit and the upper discharge outlet of the pump assembly with the tubing;

a port in the conduit within the capsule for communicating the well fluid with the pump assembly; and a port valve that selectively opens and closes the port without affecting communication between the conduit and the tubing.

16. The well assembly according to claim 15, further comprising a check valve at the upper discharge outlet of the pump assembly for allowing upward flow but preventing downward flow.

17. The well assembly according to claim 15, further comprising a retrievable plug in the conduit above the port.

18. The well assembly according to claim 15, wherein the port valve comprises a sliding sleeve.

19. The well assembly according to claim 15, wherein the manifold comprises a tubular member having a chamber, the upper discharge outlet of the pump assembly, the upper end of the conduit, and a lower end of the tubing being in communication with the chamber.

20. The well assembly according to claim 15, wherein the port valve comprises a sliding sleeve that is actuated remotely at a surface of a well by hydraulic fluid pressure.

21. The well assembly according to claim 15, wherein the port valve is biased normally open.

22. A method of pumping fluid from a well comprising:

supporting a downhole pump assembly with a string of tubing, the pump assembly having an intake and a discharge outlet that communicates with the tubing;

enclosing the pump assembly in a capsule;

selectively communicating a well fluid with an interior of the capsule and the pump assembly; operating the pump assembly so as to pump the well fluid up the tubing; then, for maintenance, shutting off the pump assembly;

blocking the well fluid from the interior of the capsule; and applying pressure to the well fluid surrounding the capsule, the capsule isolating the pump assembly from the pressure.

23. The method according to claim 22, further comprising providing a conduit through the capsule; and lowering a tool through the tubing, the conduit, and into the well below the capsule.

24. The method according to claim 22, wherein the pressure is applied to the well fluid by pumping from the surface down the tubing.

* * * * *